US006546225B2

(12) United States Patent
Wang

(10) Patent No.: US 6,546,225 B2
(45) Date of Patent: Apr. 8, 2003

(54) AUGER FOR DISPENSING WASTE TONER

(75) Inventor: Liqun Larry Wang, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/790,146

(22) Filed: Feb. 21, 2001

(65) Prior Publication Data

US 2002/0114651 A1 Aug. 22, 2002

(51) Int. Cl.[7] ..... G03G 21/00
(52) U.S. Cl. ..... 399/358
(58) Field of Search ..... 399/358, 256

(56) References Cited

U.S. PATENT DOCUMENTS

| | | | |
|---|---|---|---|
| 3,927,937 | A | 12/1975 | De Keyzer |
| 3,950,092 | A | 4/1976 | Zoltner |
| 4,218,126 | A | 8/1980 | Takeichi |
| 4,386,695 | A | 6/1983 | Olson |
| 4,593,997 | A | 6/1986 | Fox et al. |
| 4,614,162 | A | 9/1986 | Ryan et al. |
| 4,630,653 | A | 12/1986 | Kan |
| 5,090,593 | A | 2/1992 | Ejike |
| 5,101,961 | A | 4/1992 | Bengtson |
| 5,146,270 | A | 9/1992 | Matsuo et al. |
| 5,204,721 | A | 4/1993 | Sharpe |
| 5,268,720 | A | 12/1993 | Saitoh et al. |
| 5,289,241 | A | 2/1994 | Sugiyama et al. |
| 5,381,217 | A | 1/1995 | Ishida |
| 5,436,703 | A | 7/1995 | DeYoung et al. |
| 5,541,715 | A | 7/1996 | Katoh et al. |
| 5,617,195 | A | 4/1997 | Torimaru et al. |
| 5,742,882 | A | 4/1998 | Lee |
| 5,815,784 | A | 9/1998 | Kasahara et al. |
| 5,848,342 | A | 12/1998 | Tanda |
| 5,852,762 | A | 12/1998 | Hatta et al. |
| 5,933,696 | A | 8/1999 | Howard et al. |
| 5,970,303 | A | 10/1999 | Bares et al. |

FOREIGN PATENT DOCUMENTS

| | | | |
|---|---|---|---|
| JP | 59-100472 | * | 6/1984 |
| JP | 5-72952 | * | 3/1993 |
| JP | 5-165381 | * | 7/1993 |
| JP | 5-188834 | * | 7/1993 |
| JP | 6-110357 | * | 4/1994 |

* cited by examiner

*Primary Examiner*—Quana M. Grainger
(74) *Attorney, Agent, or Firm*—Taylor & Aust P.C.

(57) ABSTRACT

A waste toner container and auger therefor. Auger flights have a continuously decreasing flight pitch from the front of the auger to the back of the auger. The auger includes a flightless portion near the back wall of the container.

20 Claims, 1 Drawing Sheet

AUGER FOR DISPENSING WASTE TONER

BACKGROUND OF THE INVENTION

1. Field of the Invention

The present invention relates to electrophotographic imaging apparatus, and more particularly to a waste toner collection apparatus used therein.

2. Description of the Related Art

In the electrophotographic process commonly used in imaging apparatus such as laser printers, copy machines and the like, an electrostatic image is created upon a photosensitive member, such as a roll or belt. Visible electroscopic marking particles, commonly referred to as toner, are applied to the electrostatic image on the photosensitive material. Thereafter, the toner image is transferred to the desired media, which may include paper, transparency sheets or the like. The toner image is subsequently affixed to the underlying media by the application of heat and pressure in a fuser.

While a substantial portion of the toner image is transferred to the media, a residual amount of toner may remain on the photosensitive member. To prepare the photosensitive member for receiving a subsequent electrostatic image, and an accurate toner image thereof to transfer to a subsequent media, it is necessary to clean the photosensitive material, and remove all residual toner from the previous image. Toner remaining from the previous image can decrease the print quality of a subsequent image. A known method for removing residual toner includes the operation of a scraping blade of elastomeric material against the photosensitive material. The residual toner is scraped from the photosensitive material and collected in various ways for subsequent transfer to a waste toner tank or container. Periodically, the waste toner container can be emptied, or simply removed and replaced with an empty container. However, such a removal process can be messy, and contamination of the machine interior can adversely affect print quality. Clean-up thereof is difficult.

It is desirable that waste toner collection capacity be sufficient to correspond with machine page life expectancy, so that removal of the waste toner container from the machine can be performed by trained personnel as part of life-expectancy servicing. A smaller capacity container requires design for periodic user servicing, or can result in service calls simply to remove and empty or replace the waste toner container.

Even with the high toner transfer efficiencies common in present day machines, with the extended life expectancy also common in current machines, the interior machine space required for waste toner collection can be significant. For example, assuming a 90% transfer efficiency of toner to media in a machine having a 100,000 page life expectancy, it may be required to collect as much as 760 grams or 1,810 cc of toner (assuming 0.42 g/cc). Assuming 100% packing efficiency of the space inside the container, a container having a 1,810 cubic centimeter volume is required. If the waste toner container is not efficiently packed with waste toner, a larger volume is required, which may present design difficulties in current machine compact architecture having limited internal space.

It is known to provide a dispensing auger running the length of a relatively long and narrow waste toner container. While such augers have been helpful in distributing waste toner along the length of the container, lateral distribution of the waste toner away from the auger has not been efficient. Further, toner can pack between the last flight of the auger and the back wall of the container, undesirably increasing the driving torque required for rotating the auger. Toner compressed between the last auger flight and back wall of the container also can leak around the auger shaft in the bearing hole in the back of the container. Toner particles leaking from the waste toner container can contaminate working surfaces of the machine, interfering with operation of the machine and degrading print quality.

What is needed is an augering system in a waste toner container which promotes lateral distribution of toner away from the auger, and which minimizes toner packing between the auger and container walls, thereby improving utilization of the container capacity; and reducing the possibility of toner leakage and the driving torque required for turning the auger.

SUMMARY OF THE INVENTION

The present invention provides a waste toner container for an imaging apparatus, the waste toner container having an auger therein designed to promote lateral distribution of toner as toner is moved from one end of the container to the other end of the container, while reducing toner spill from the container and reducing drive torque requirements.

The invention comprises, in one form thereof, a waste toner collecting device including a waste toner container having a bottom, a front wall, a back wall and side walls defining an enclosed space for receiving waste toner. An auger is operatively disposed in the container, the auger having a front end and a back end rotatably retained in the front wall and the back wall, respectively. The auger includes flights designed for decreasing toner transport in an axial direction and increasing toner transport in a lateral direction from the front end to the back end.

The invention comprises, in another form thereof, a method for distributing waste toner in a waste toner container, having steps of providing an elongated container having front and back walls spaced from each other a length of the container, and side walls spaced from each other a width of the container; providing an auger in the container, the auger extending along the container length and having adjacent flights along the length thereof, the auger having a front end and a back end; rotating the auger to transport toner along the flights; transporting the toner along the length at a decreasing rate from the front end to the back end; and transporting the toner across the width at an increasing rate from the front end to the back end.

The invention comprises, in yet another for m thereof; an auger for an elongated waste toner container having a length and a width, a front wall and a back wall spaced from each other defining the container length and side walls spaced from each other defining the container width. A shaft is rotatably disposed in the front wall and the back wall, and extends through the container length. Flights are provided on the shaft for transporting toner from the front wall toward the back wall. The flights are disposed at a varying pitch angle along the length to decrease toner transport in the direction of the length and increase toner transport in the direction of the width as the toner moves from the front wall to the back wall.

The invention comprises, in still another form thereof, an auger for an elongated waste toner container having a length and a width, a front wall and a back wall spaced from each other defining the container length and side walls spaced from each other defining the container width. A shaft is rotatably disposed in the front wall and the back wall and extending along the container length. Flights on the shaft are disposed near the front wall and spaced from the rear wall to define a flightless segment of the shaft in the container.

An advantage of the present invention is that waste toner container volume is used more efficiently.

Another advantage is having a waste toner container auger having reduced drive torque requirements.

Yet another advantage is having a waste toner container having reduced toner spillage or leakage.

BRIEF DESCRIPTION OF THE DRAWINGS

The above-mentioned and other features and advantages of this invention, and the manner of attaining them, will become more apparent and the invention will be better understood by reference to the following description of embodiments of the invention, taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
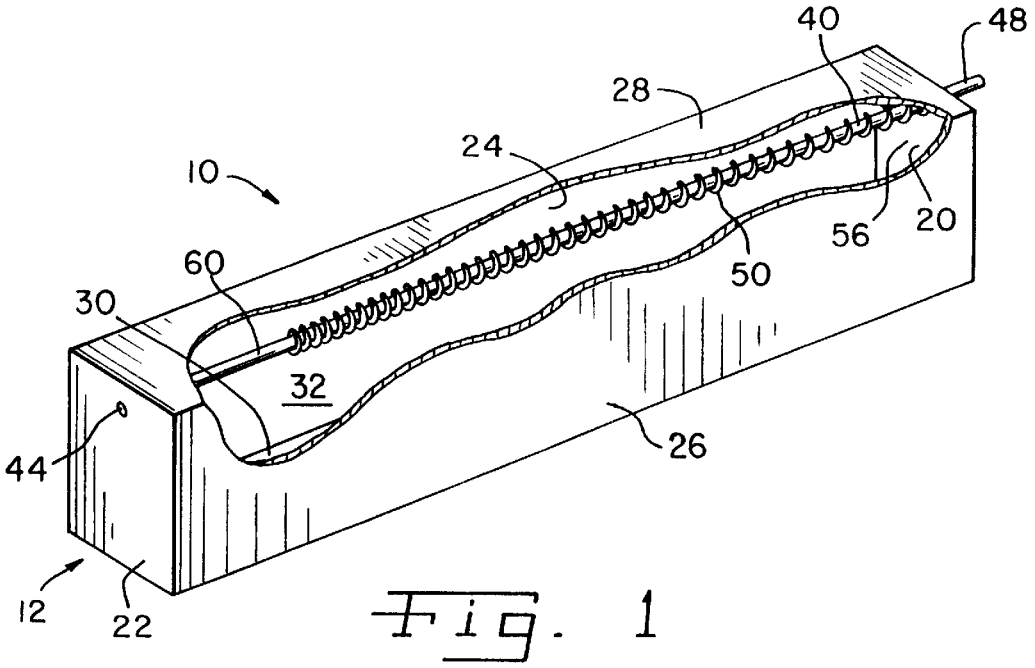
FIG. 1 is a perspective view of a waste toner container, partially broken away to reveal an auger therein.

Referring now to the drawings and particularly to FIG. 1, there is shown a waste toner collecting device 10, including a container 12 and an auger 14 in accordance with the present invention. Collecting device 10 is part of a waste toner removal system (not shown) in a laser printer, copy machine or the like. A waste toner removal system will include a doctor blade, brush or other scraping device for removing residual toner from a photo-conductive drum, intermediate belt or the like. Slides, chutes, vibrating surface and other toner transport apparatus conduct the toner from a gathering area to collecting device 10.

Container 12 is a box-like structure having a front wall 20, a back wall 22 and side walls 24 and 26. Front wall 20 and back wall 22 are spaced from each other a distance the length of side walls 24 and 26, and define therebetween a length of container 12. Side walls 24 and 26 are spaced from each other a distance the width of front wall 20 and back wall 22, and define therebetween a width of container 12. Normally, front wall 22 and back wall 24 are parallel to each other, as are sidewalls 24 and 26 parallel to each other. Front and back walls 20 and 22, thereby, are disposed at right angles to side walls 24 and 26.

Container 12 further includes a top 28 and a bottom 30, each disposed between top and bottom edges, respectively, of front wall 20, back wall 22 and side walls 24 and 26. Top 28, bottom 30, front and back walls 20 and 22 and side walls 24 and 26 define an enclosed space 32 of container 12, the enclosed space having a volume, and being adapted for collecting waste toner therein.

Auger 14 is disposed in container 12, extending from front wall 20 to back wall 22, normally positioned centrally between side walls 24 and 26 and slightly below top 28. Auger 14 includes a shaft 40 rotatably retained in front wall 20 and back wall 22 of container 12. A back end 42 of shaft 40 is secured for rotation in a bearing hole 44 of back wall 22, and may project a minimal distance outwardly of back wall 22. A front end 46 of shaft 40 is secured for rotation in front wall 20, in a bearing hole (not shown), similar to bearing hole 44 in back wall 22. Shaft 40 includes an outwardly extending portion 48 for connecting shaft 40 to a rotational drive means (not shown).

Auger 14 further includes a plurality of flights 50 on shaft 40, flights 50 extending radially outwardly from shaft 40. In the embodiment shown, flights 50 are defined by a continuous flight body spiraling around shaft 40 for a predetermined length thereof. Those skilled in the art will recognize that flights 50 also can be a series of two or more individual flight body segments disposed around the outer surface and along the length of shaft 40. A volume is defined between adjacent flight 50 surfaces, from the base of flights 50 at shaft 40 to the outer edge of flights 50.

Figure 2:
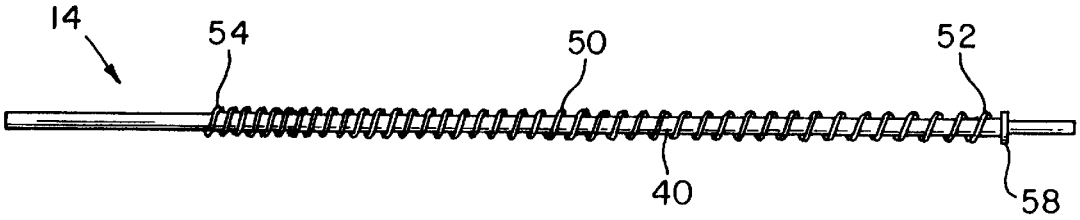
FIG. 2 is an elevational view of the auger shown in FIG. 2.
Figure 3:
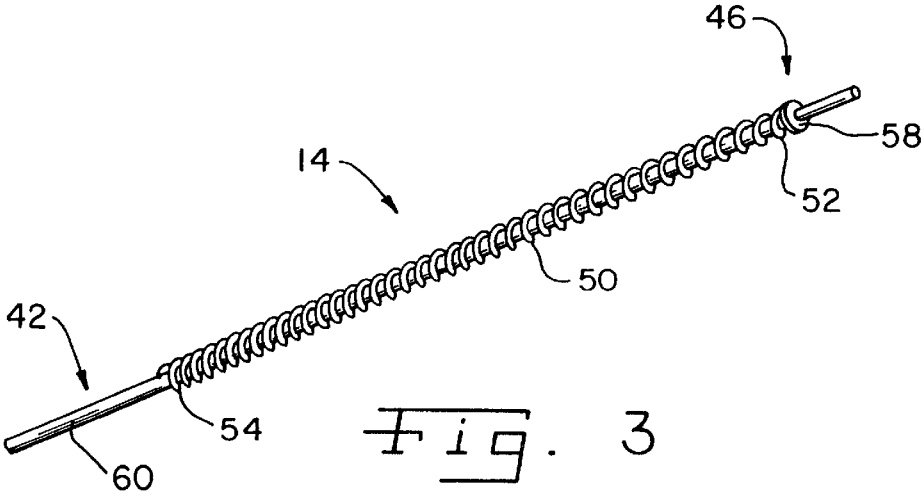
FIG. 3 is a perspective view of the auger shown in FIG. 1.

When viewed in elevation as shown in FIG. 2, for any rotational position of shaft 40, flights 50 appear as individual elements spaced from each other and disposed at an angle relative to an axis defined by shaft 40. In accordance with the present invention, a different flight pitch is provided for flights 50 at one end of auger 14, than for flights 50 at the other end of the auger 14. For auger 14 shown in the drawings, the flight pitch continuously varies from a first flight 52 to a last flight 54, and as shown, is a continuously decreasing flight pitch. By "continuously" decreasing is meant that the pitch of adjacent flights 50 decrease from one flight 50 to the adjacent flight 50, in the direction from first flight 52 to last flight 54. This can be observed most clearly in FIG. 2, wherein it can be seen that flights 50 become progressively closer to each other from first flight 52 to last flight 54. However, it should be understood that while a continuously varying pitch is preferred, the invention can also be practiced with several adjacent flights 50 in a group each having the same flight pitch, followed by a second group of flights 50 having a decreased flight pitch, so long as there is a decreasing flight pitch from first flight 52 toward last flight 54.

In accordance with another feature of the present invention, flights 50 extend from just inside front wall 20 rearwardly in container 12, but not fully to back wall 22. First flight 52 is only minimally spaced from an inside surface 56 of front wall 20, and is restrained by a washer 58 from binding against surface 56 during rotation of shaft 40. Last flight 54 is spaced a significant distance from an inside surface (not shown) of back wall 22, and shaft 40, therefore, includes a flightless portion 60 within container 12.

During use of collecting device 10, waste toner entering container 12 is moved toward back wall 22 by rotation of auger 14. The axial delivery rate of an auger is the rate at which material is transported along the axial direction of the auger shaft. In a conventional auger, having a constant flight pitch through out the auger length, the auger delivery rate in the axial direction of shaft 40 is dependent upon the volume in each flight along the length of the auger. With a decreasing flight pitch from the front of container 12, toward the back of container 12, as described for the present invention, the volume between adjacent flights 50 is decreased, and the delivery rate along the length of auger 14 decreases from first flight 52 to last flight 54. The excess volume is driven laterally in container 12, in essence forced outwardly from auger 14 by the decreasing volume between adjacent flights 50. Thus, axial displacement decreases, and lateral displacement increases as the toner is moved from front wall 20 toward back wall 22.

Positive axial and lateral displacement by auger 14 terminates as toner reaches last flight 54. Falling toner on a pile of toner building on bottom 30 continues to slide both axially and laterally in container 12 beyond last flight 54. However, with last flight 54 spaced from back wall 22 by flightless portion 60 of shaft 40, toner is not driven against back wall 22 by auger 14, nor against or through bearing hole 44. By eliminating packing or wedging of toner between flights 50 and any of walls 20, 22, 24 or 26, shaft 40 can be rotated with minimal drive torque.

The initial flight pitch, final flight pitch, the rate and nature of flight pitch decrease, the flight size, and the length of flightless portion 60 and the like can be varied in relationship to the dimensions of container 12 and the physical properties of toner to be accumulated in container 12.

In a prototype test of a container having an internal volume of 2040 cubic centimeters (40 cm×6 cm×8.5 cm) an auger of 400 mm in length included a flightless portion of 60 mm, or approximately fifteen percent (15%) of the total shaft length in the container. A continuously decreasing flight had a flight pitch of 10 mm at the first flight, immediately inside of the front wall of the container, and decreased steadily to a 4.5 mm flight pitch at the last flight before the flightless portion of the auger. Over ninety percent (90%) of the internal volume of the container was filled with less than 7 oz. in driving torque required.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A waste toner collecting device comprising:

a waste toner container having a bottom, a front wall, a back wall and side walls defining an enclosed space for receiving waste toner; and an auger operatively disposed in said container, said auger having a front end and a back end rotatably retained in said front wall and said back wall, respectively, said auger including a plurality of flights adapted and arranged with said container for decreasing toner transport in an axial direction and increasing toner transport in a lateral direction within said container from said front end to said back end of said container.

2. The waste toner collecting device of claim 1, said flights having a different flight pitch at said front end than at said back end.

3. The waste toner collecting device of claim 1, said auger having a first flight nearest said front wall and a last flight nearest said back wall, and said flights having a continuously decreasing flight pitch from said first flight to said last flight.

4. The waste toner collecting device of claim 1, said auger having a continuous flight body defining adjacent flights, with a continuously decreasing flight pitch from said front end to said back end.

5. The waste toner collecting device of claim 1, said auger including a shaft having a first flight near said front wall and a last flight spaced from said back wall, said shaft having a flightless portion in said container between said last flight and said back wall.

6. The waste toner collecting device of claim 5, said shaft flightless portion between said last flight and said back wall comprising approximately 15% of a distance between said front wall and said back wall.

7. The waste toner collecting device of claim 5, said plurality of flights varying in flight pitch from said first flight to said last flight.

8. The waste toner collecting device of claim 7, said auger having a continuous flight body defining adjacent flights.

9. The waste toner collecting device of claim 8, said continuous flight body continuously decreasing in flight pitch.

10. The waste toner collecting device of claim 1, said flights defining a decreasing flight volume from said front end to said back end.

11. A method for distributing waste toner in a waste toner container, said method comprising steps of:

providing an elongated container having front and back walls spaced from each other a length of the container, and side walls spaced from each other a width of the container;

providing an auger in the container, the auger extending along the container length and having a plurality of adjacent flights, including a first flight and a last flight;

rotating the auger to transport toner along the flights;

transporting the toner along the length of the container at a decreasing rate from the first flight to the last flight; and transporting the toner across the width of the container at an increasing rate from the first flight to the last flight.

12. The method of claim 11, including providing a flightless portion on the auger inwardly of the back wall, and terminating said steps of transporting the toner at a spaced distance from the back wall.

13. An auger for dispensing toner in an elongated waste toner container having a length and a width, a front wall and a back wall spaced from each other defining said length and side walls spaced from each other defining said width, said auger comprising:

a shaft rotatably disposed between said front wall and said back wall;

flights on said shaft for transporting toner away from said front wall and toward said back wall; and said flights disposed at a varying pitch angle along said length to decrease a rate of toner delivery within said waste toner container in the direction of said length and to increase a rate of toner delivery within said waste toner container in the direction of said width as toner moves from said front wall to said back wall.

14. The auger of claim 13, said flights having a decreasing pitch angle along said length from said front wall toward said back wall.

15. The auger of claim 13, said flights having a continuously decreasing pitch angle from said front wall toward said back wall.

16. The auger of claim 15, said shaft including a flightless portion inwardly of said back wall.

17. The auger of claim 13, said shaft including a flightless portion inwardly of said back wall.

18. The auger of claim 17, said flightless portion of said shaft comprising approximately 15% of the total length of said shaft.

19. An auger for an elongated waste toner container having a length and a width, a front wall and a back wall spaced from each other defining said length and side walls spaced from each other defining said width, said auger comprising:

a shaft rotatably disposed between said front wall and said back wall;

a plurality of adjacent flights on said shaft, including a first flight disposed near said front wall and a last flight spaced from said back wall to define a flightless portion of said shaft inwardly of said back wall, said flightless portion of said shaft comprising approximately 15% of said length.

20. The auger of claim 19, including a continuous flight body disposed about said shaft, said continuous flight body defining said plurality of adjacent flights.

* * * * *